US008942908B2

(12) United States Patent
Worthing et al.

(10) Patent No.: US 8,942,908 B2
(45) Date of Patent: Jan. 27, 2015

(54) PRIMARY TORQUE ACTUATOR CONTROL SYSTEMS AND METHODS

(75) Inventors: James L. Worthing, Munith, MI (US); Paul A. Bauerle, Fenton, MI (US)

(73) Assignee: GM Global Technology Operations LLC

( * ) Notice: Subject to any disclaimer, the term of this patent is extended or adjusted under 35 U.S.C. 154(b) by 1308 days.

(21) Appl. No.: 12/771,244

(22) Filed: Apr. 30, 2010

(65) Prior Publication Data

US 2011/0270507 A1 Nov. 3, 2011

(51) Int. Cl.

| | |
|---|---|
| ***F02D 45/00*** | (2006.01) |
| ***F02D 11/10*** | (2006.01) |
| ***F02D 41/04*** | (2006.01) |
| ***F02D 41/22*** | (2006.01) |

(52) U.S. Cl.

CPC ..... *F02D 11/107* (2013.01); *F02D 41/042* (2013.01); *F02D 41/22* (2013.01); *F02D 2041/227* (2013.01); *F02D 2200/602* (2013.01)

USPC ..... 701/102; 123/198 D; 73/114.36

(58) Field of Classification Search

USPC ..... 701/102, 107, 110–112, 114; 123/198 D, 198 DB, 198 DC, 198 F, 123/179.4, 339.1, 339.11, 339.15, 361, 376, 123/377, 397, 399, 403; 73/114.13, 114.15, 73/114.36

See application file for complete search history.

(56) References Cited

U.S. PATENT DOCUMENTS

| | | | | |
|---|---|---|---|---|
| 3,698,372 | A * | 10/1972 | Eshelman et al. | 123/198 DB |
| 5,018,383 | A * | 5/1991 | Togai et al. | 73/114.32 |
| 6,330,873 | B1 * | 12/2001 | Letang et al. | 123/322 |
| 6,345,603 | B1 * | 2/2002 | Abboud et al. | 123/397 |
| 6,687,601 | B2 * | 2/2004 | Bale et al. | 701/108 |
| 6,883,496 | B2 * | 4/2005 | Suzuki et al. | 123/361 |
| 6,964,260 | B2 * | 11/2005 | Samoto et al. | 123/406.13 |
| 7,305,300 | B2 * | 12/2007 | Gibson et al. | 701/110 |
| 8,439,017 | B2 * | 5/2013 | Peters et al. | 123/520 |
| 2002/0066435 | A1 * | 6/2002 | Okamoto | 123/396 |
| 2002/0100278 | A1 * | 8/2002 | He et al. | 60/600 |
| 2003/0062025 | A1 * | 4/2003 | Samoto et al. | 123/396 |
| 2004/0007208 | A1 | 1/2004 | Suzuki et al. | |
| 2007/0192018 | A1 * | 8/2007 | Gibson et al. | 701/110 |
| 2008/0064567 | A1 * | 3/2008 | Kue et al. | 477/109 |

(Continued)

FOREIGN PATENT DOCUMENTS

| | | |
|---|---|---|
| CN | 101408136 | 4/2009 |

OTHER PUBLICATIONS

Toyota Motor Sales, U.S.A., Inc. All Rights Reserved.*

*Primary Examiner* — John Kwon
*Assistant Examiner* — Johnny H Hoang

(57) ABSTRACT

An engine control system includes a coordinated torque control (CTC) module, a diagnostic module, and an actuator limiting module. The CTC module determines a first position for a throttle valve of a spark-ignition, internal combustion engine and controls opening of the throttle valve based on the first position. The diagnostic module selectively diagnoses an engine shutdown fault and disables the control of the opening of the throttle valve based on the first position when the engine shutdown fault is diagnosed. The actuator limiting module determines a second position for the throttle valve based on an accelerator pedal position, selects a lesser one of the first and second positions, and selectively limits the opening of the throttle valve to the lesser one of the first second positions when the engine shutdown fault is diagnosed.

20 Claims, 7 Drawing Sheets

(56) References Cited

U.S. PATENT DOCUMENTS

| | | | | |
|---|---|---|---|---|
| 2008/0249698 | A1* | 10/2008 | Yokoyama et al. | 701/107 |
| 2008/0288153 | A1* | 11/2008 | Bauerle et al. | 701/101 |
| 2009/0088946 | A1* | 4/2009 | Bauerle et al. | 701/103 |
| 2009/0114003 | A1* | 5/2009 | Wegener et al. | 73/114.79 |
| 2009/0240418 | A1* | 9/2009 | Bauerle et al. | 701/103 |
| 2009/0240420 | A1* | 9/2009 | Ishigami et al. | 701/103 |
| 2009/0301451 | A1* | 12/2009 | Ito | 123/674 |
| 2009/0327821 | A1* | 12/2009 | Bauerle et al. | 714/704 |
| 2010/0082220 | A1* | 4/2010 | Whitney et al. | 701/102 |
| 2010/0114452 | A1* | 5/2010 | Bauerle | 701/102 |
| 2010/0217472 | A1 | 8/2010 | Stempnik et al. | |

* cited by examiner

PRIMARY TORQUE ACTUATOR CONTROL SYSTEMS AND METHODS

FIELD

The present disclosure relates to internal combustion engines and more particularly to engine actuator control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts throttle position, which increases or decreases air flow into the engine. As the throttle position increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

Engine control systems have been developed to control engine output torque to achieve a desired torque. Traditional engine control systems, however, do not control the engine output torque as accurately as desired. Further, traditional engine control systems do not provide a rapid response to control signals or coordinate engine torque control among various devices that affect the engine output torque.

Traditional engine control systems control engine output torque using air flow in spark-ignition engines and using fuel in compression-ignition engines. When one or more faults are diagnosed in an engine control module (ECM), traditional engine control systems shut down (i.e., turn off) the engine. For example only, traditional engine control systems may disable fuel to the engine and/or prevent or limit airflow into the engine to accomplish engine shutdown.

SUMMARY

An engine control system includes a coordinated torque control (CTC) module, a diagnostic module, and an actuator limiting module. The CTC module determines a first position for a throttle valve of a spark-ignition, internal combustion engine and controls opening of the throttle valve based on the first position. The diagnostic module selectively diagnoses an engine shutdown fault and disables the control of the opening of the throttle valve based on the first position when the engine shutdown fault is diagnosed. The actuator limiting module determines a second position for the throttle valve based on an accelerator pedal position, selects a lesser one of the first and second positions, and selectively limits the opening of the throttle valve to the lesser one of the first second positions when the engine shutdown fault is diagnosed.

An engine control system includes a coordinated torque control (CTC) module, a diagnostic module, and an actuator limiting module. The CTC module determines a first position for a throttle valve of a compression-ignition, internal combustion engine and controls provision of fuel to the engine based on the first fueling amount. The diagnostic module selectively diagnoses an engine shutdown fault and disables the control of the provision of fuel based on the first fueling amount when the engine shutdown fault is diagnosed. The actuator limiting module determines a second fueling amount for the engine based on an accelerator pedal position, selects a lesser one of the first and second fueling amounts, and selectively limits the provision of fuel to the engine to the lesser one of the first and second fueling amounts after the engine shutdown fault is diagnosed.

An engine control method includes: determining a first position for a throttle valve of a spark-ignition, internal combustion engine; controlling opening of the throttle valve based on the first position; selectively diagnosing an engine shutdown fault; disabling the control of the opening of the throttle valve based on the first position when the engine shutdown fault is diagnosed; determining a second position for the throttle valve based on an accelerator pedal position; selecting a lesser one of the first and second positions; and selectively limiting the opening of the throttle valve to the lesser one of the first second positions when the engine shutdown fault is diagnosed.

An engine control method includes: determining a first position for a throttle valve of a compression-ignition, internal combustion engine; and controlling provision of fuel to the engine based on the first fueling amount; selectively diagnosing an engine shutdown fault; and disabling the control of the provision of fuel based on the first fueling amount when the engine shutdown fault is diagnosed; determining a second fueling amount for the engine based on an accelerator pedal position; selecting a lesser one of the first and second fueling amounts; and selectively limiting the provision of fuel to the engine to the lesser one of the first and second fueling amounts after the engine shutdown fault is diagnosed.

In still other features, the systems and methods described above are implemented by a computer program executed by one or more processors. The computer program can reside on a tangible computer readable medium such as but not limited to memory, nonvolatile data storage, and/or other suitable tangible storage mediums.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
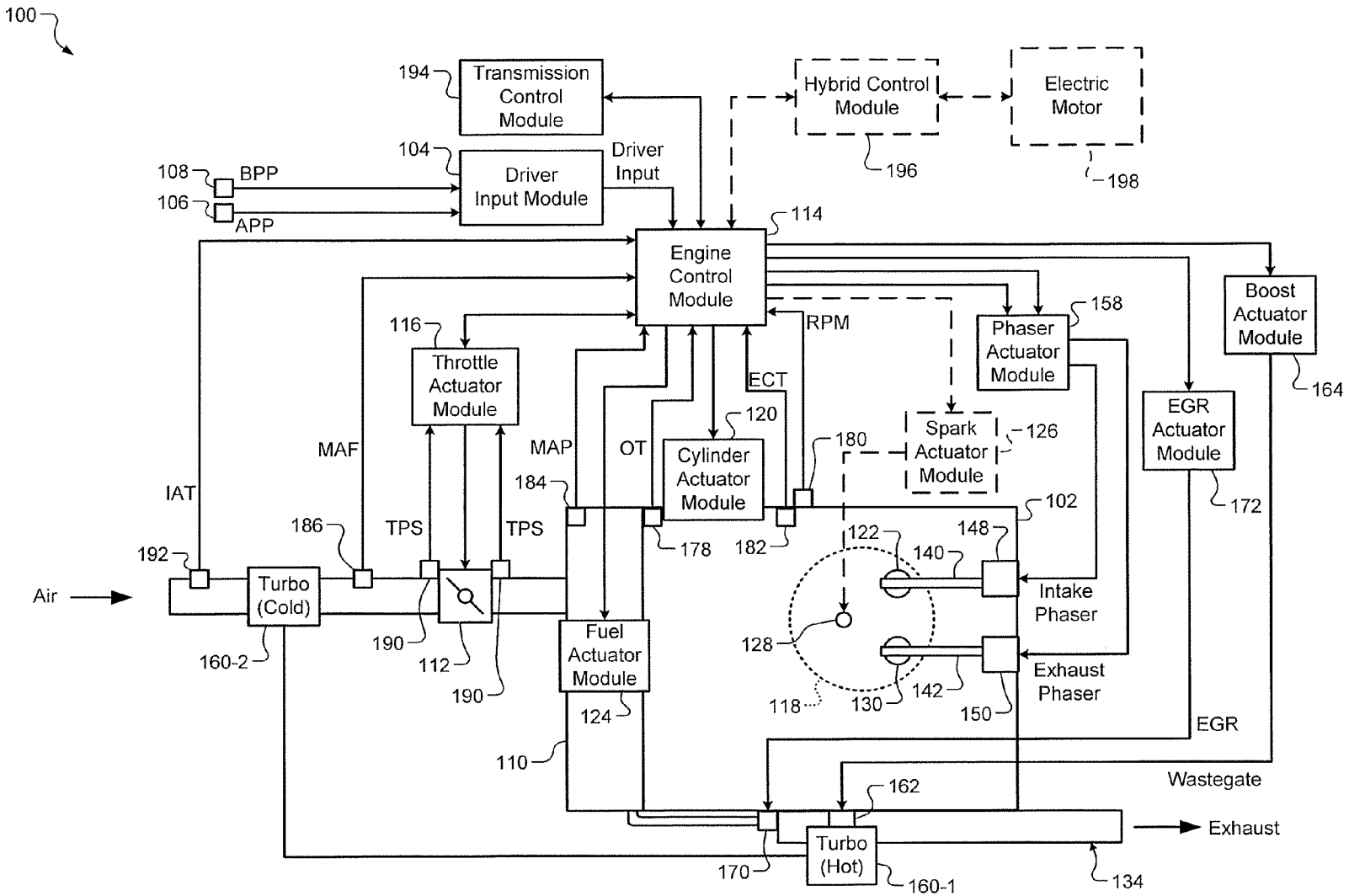
FIG. 1 is a functional block diagram of an exemplary implementation of an engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Figure 2:
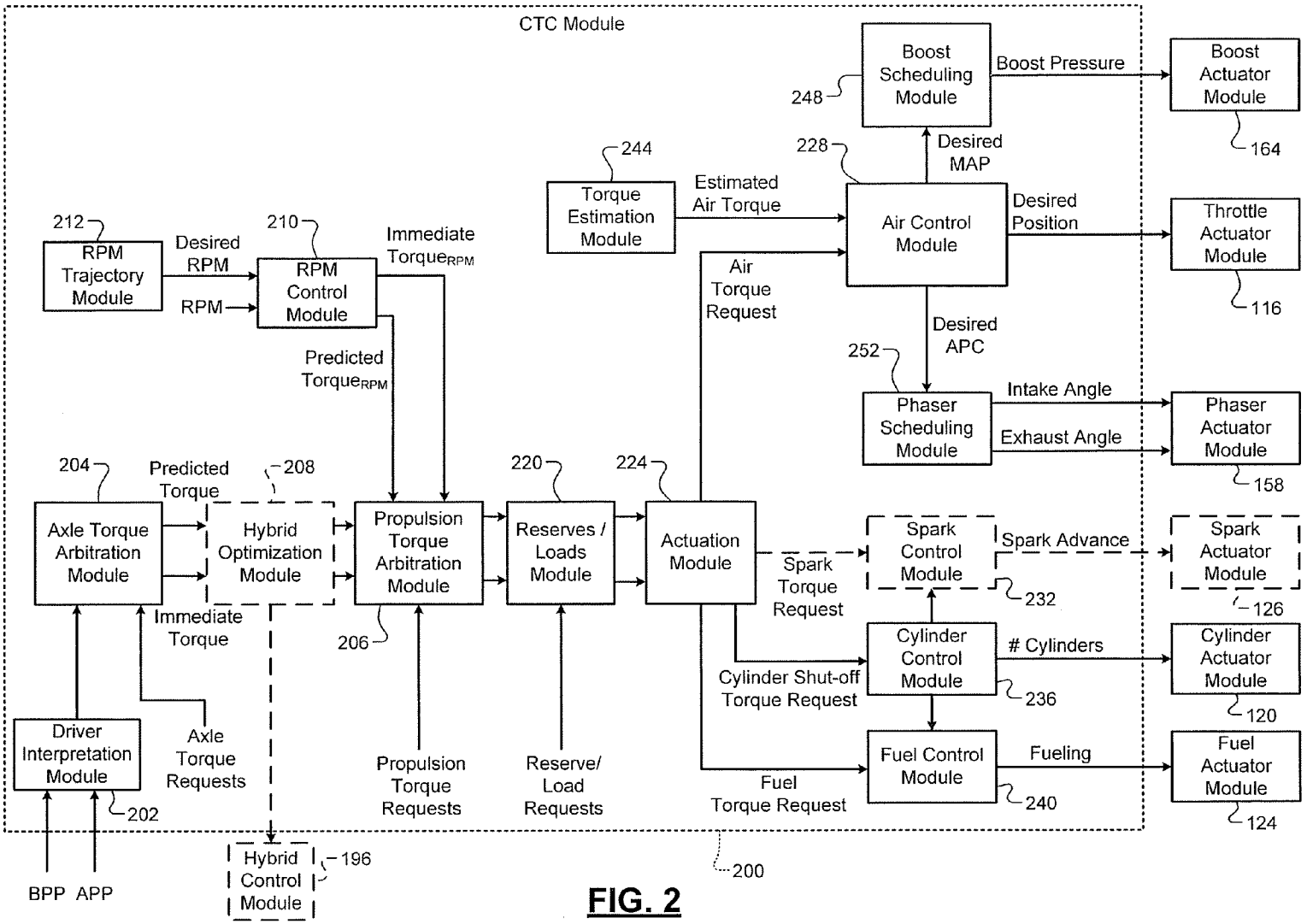
FIG. 2 is a functional block diagram of an exemplary implementation of a coordinated torque control (CTC) system according to the principles of the present disclosure.

FIG. 1 includes a functional block diagram of an exemplary engine system that includes a plurality of engine actuators, such as a fuel actuator module, a throttle actuator module, a spark actuator module. FIG. 2 includes a functional block diagram of an exemplary coordinated torque control module that controls the engine actuators.

Each engine actuator controls a parameter that affects the amount of torque produced by an engine. An engine actuator controls the parameter based on an actuator value provided to the engine actuator. A primary torque actuator may be an engine actuator that can affect the amount of torque output by the engine to a greater extent than the other engine actuators.

Figure 3A:
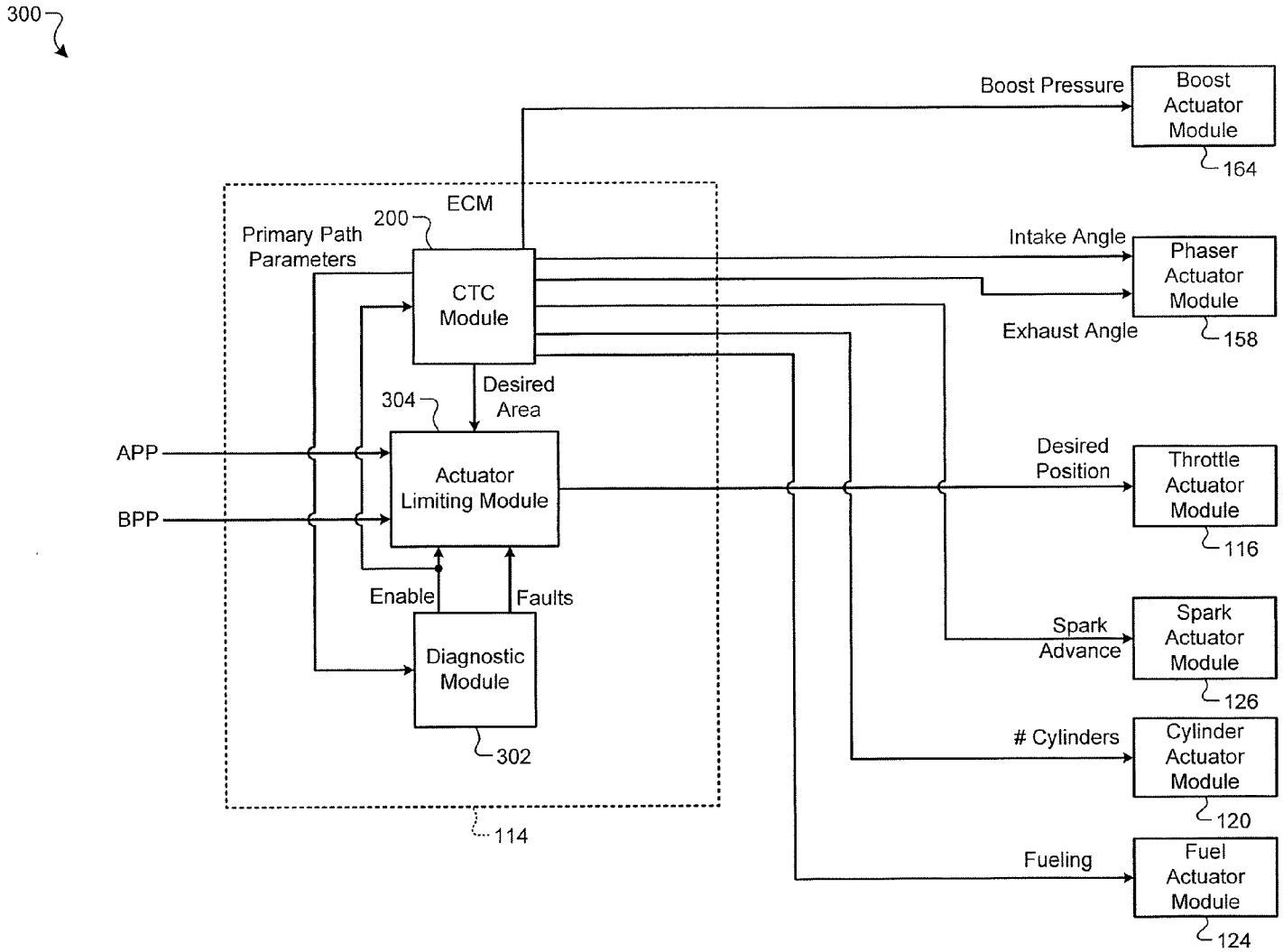
FIGS. 3A and 3B are functional block diagrams of exemplary engine control systems for spark-ignition and compression-ignition engine systems, respectively, according to the principles of the present disclosure.
Figure 3B:
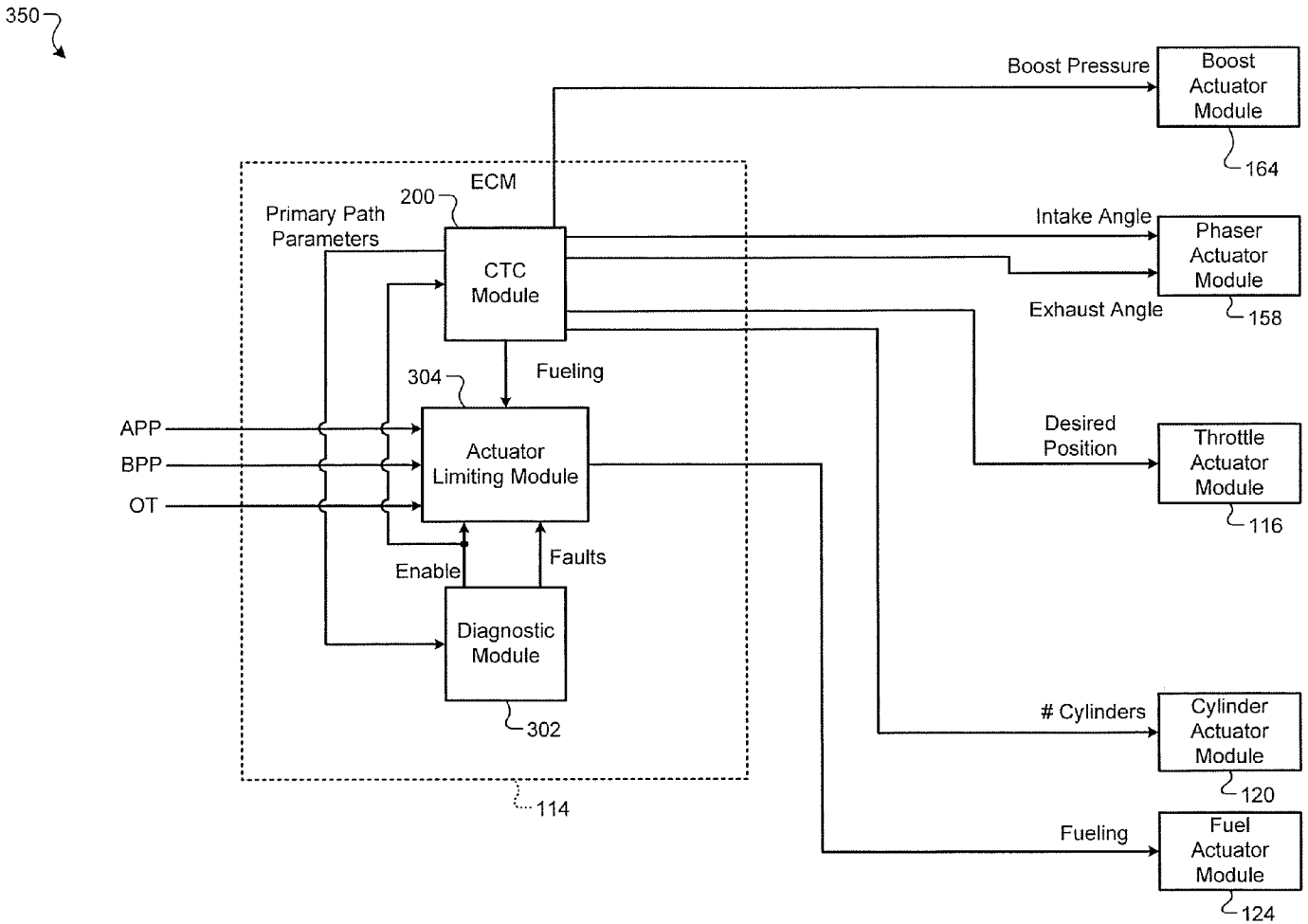

For example only, the throttle actuator module may be a primary torque actuator in spark-ignition engine systems, and the fuel actuator module may be a primary torque actuator in compression-ignition engine systems. FIGS. 3A and 3B include functional block diagrams of exemplary engine control systems that control the primary torque actuator for spark-ignition engine systems and compression-ignition engine systems, respectively.

In some circumstances, one or more faults may be attributed to an engine control module (ECM), such as a dual path fault and/or a dual storage fault. Generally, the ECM may shut down the engine when a dual path fault and/or a dual storage fault is diagnosed in the ECM.

For example only, the coordinated torque control module may determine a parameter based on one or more inputs and one or more relationships that relate the one or more inputs to the parameter. A diagnostic module may determine a second version of the parameter based on the one or more inputs and one or more similar or identical relationships. The diagnostic module may diagnose a dual path fault in the ECM when the parameter and the second version of the parameter differ by more than a predetermined amount or percentage.

For another example only, the coordinated torque control module may selectively store values in two predetermined locations. The diagnostic module may retrieve the two values from the predetermined locations. When the two values differ from each other or from expected values, the diagnostic module may diagnose a dual storage fault in the ECM.

Instead of shutting down the engine when a dual path fault and/or a dual storage fault is diagnosed, the ECM of the present disclosure determines a limited actuator value for the primary torque actuator. The ECM compares the limited actuator value with the actuator value determined by the coordinated torque control module.

The ECM controls the primary torque actuator based on a lesser one of the two actuator values. In this manner, the ECM allows a driver of a vehicle to operate the engine, albeit to a limited extent, instead of shutting down the engine. This opportunity may allow the driver to drive the vehicle to a desired location, such as the driver's home or a vehicle service location.

Referring now to FIG. 1, a functional block diagram of an exemplary engine system 100 is presented. The engine system 100 includes an engine 102 that combusts an air/fuel mixture to produce drive torque for a vehicle based on driver inputs from a driver input module 104. For example only, the driver inputs may include one or more accelerator pedal positions (APPs) measured by one or more APP sensors, such as APP sensor 106, and one or more brake pedal positons (BPPs) measured by one or more BPP sensors, such as BPP sensor 108.

Air is drawn into an intake manifold 110 through a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 1, 2, 3, 4, 5, 6, 8, 10, and/or 12 cylinders. The ECM 114 may instruct a cylinder actuator module 120 to selectively deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture. During the compression stroke, a piston (not shown) within the cylinder 118 compresses the air/fuel mixture. The engine 102 may be a compression-ignition engine, in which case compression in the cylinder 118 causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. The timing of the spark may be specified relative to the time when the piston is at its topmost position, referred to as top dead center (TDC). In compression-ignition engine systems, the spark actuator module 126 and the spark plug 128 may be omitted.

The spark actuator module 126 may be controlled by a timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Initiating combustion within the cylinder 118 may be referred to as a firing event. The spark actuator module 126 may have the ability to vary the timing of the spark for each firing event. In addition, the spark actuator module 126 may have the ability to vary the timing of the spark for a given firing event even when a change in the timing signal is received after the firing event immediately before the given firing event. In compression-ignition engine systems, the fuel injection timing may be varied to vary the combustion timing.

During the combustion stroke, the combustion of the air/fuel mixture drives the piston down, thereby driving the crankshaft. The combustion stroke may be defined as the time between the piston reaching TDC and the time at which the piston returns to bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The cylinder actuator module 120 may deactivate the cylinder 118 by disabling opening of the intake valve 122 and/or the exhaust valve 130. In various other implementations, the intake valve 122 and/or the exhaust valve 130 may be controlled by devices other than camshafts, such as electromagnetic actuators.

The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2, driven by the turbine 160-1, that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. The compressed air charge may also have absorbed heat from components of the exhaust system 134. Although shown separated for purposes of illustration, the turbine 160-1 and the compressor 160-2 may be attached to each other, placing intake air in close proximity to hot exhaust.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

The engine system 100 may measure the temperature of oil within the engine 102 using an engine oil temperature (OT) sensor 178. The engine system 100 may measure the speed of the crankshaft in revolutions per minute (RPM) using an RPM sensor 180. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flowrate (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The ECM 114 may communicate with a hybrid control module 196 to coordinate operation of the engine 102 and an electric motor 198.

The electric motor 198 may also function as a generator, and may be used to produce electrical energy for use by vehicle electrical systems and/or for storage in a battery. In various implementations, various functions of the ECM 114, the transmission control module 194, and the hybrid control module 196 may be integrated into one or more modules.

Each system that varies an engine parameter may be referred to as an actuator that receives an actuator value. For example, the throttle actuator module 116 may be referred to as an actuator and the throttle position may be referred to as the actuator value. In the example of FIG. 1, the throttle actuator module 116 achieves the throttle position by adjusting an angle of the blade of the throttle valve 112.

Similarly, the spark actuator module 126 may be referred to as an actuator, while the corresponding actuator value may be the amount of spark advance relative to cylinder TDC. Other actuators may include the cylinder actuator module 120, the fuel actuator module 124, the phaser actuator module 158, the boost actuator module 164, and the EGR actuator module 172. For these actuators, the actuator values may correspond to number of activated cylinders, fueling rate or mass, intake and exhaust cam phaser angles, boost pressure, and EGR valve position, respectively. The ECM 114 may control actuator values in order to cause the engine 102 to generate a desired engine output torque.

A primary torque actuator may refer to an actuator that has a greater ability to affect the engine output torque relative to the other engine actuators. One or more engine actuators associated with a given engine may be referred to as the primary torque actuator for the given engine. For example only, the throttle actuator module 116 may be a primary torque actuator in a spark-ignition engine system. Other air per cylinder (APC) affecting actuators may also be primary torque actuators in a spark-ignition engine system, such as the phaser actuator module 158 and the boost actuator module 164. In compression-ignition engine systems, the fuel actuator module 124 may be a primary torque actuator.

Referring now to FIG. 2, a functional block diagram of an exemplary coordinated torque control (CTC) module 200 of the ECM 114 is presented. An exemplary implementation of the CTC module 200 includes a driver interpretation module 202.

The driver interpretation module 202 may determine a driver torque request based on one or more of the driver inputs from the driver input module 104, such as the APP and the BPP. The driver input may also be based on cruise control inputs, which may be an adaptive cruise control system that varies vehicle speed to maintain a predetermined following distance. The driver interpretation module 202 may include one or more mappings of the APP to desired torque, and may determine the driver torque request based on a selected one of the mappings.

An axle torque arbitration module 204 arbitrates between the driver torque request from the driver interpretation module 202 and other axle torque requests. Axle torque (torque at the wheels) may be produced by various sources including the engine 102 engine and/or the electric motor 198. Torque requests may include absolute torque requests as well as relative torque requests and ramp requests. For example only, ramp requests may include a request to ramp torque down to a minimum engine off torque or to ramp torque up from the minimum engine off torque. Relative torque requests may include temporary or persistent torque reductions or increases.

The other axle torque requests may include a torque reduction requested by a traction control system when positive wheel slip is detected. Positive wheel slip occurs when axle torque overcomes friction between the wheels and the road surface, and the wheels begin to slip against the road surface. The other axle torque requests may also include a torque increase request to counteract negative wheel slip, where a tire of the vehicle slips in the other direction with respect to the road surface because the axle torque is negative.

The other axle torque requests may also include brake management requests and vehicle over-speed torque requests. Brake management requests may reduce axle torque to ensure that the axle torque does not exceed the ability of the brakes to hold the vehicle when the vehicle is stopped. Vehicle over-speed torque requests may reduce the axle torque to prevent the vehicle from exceeding a predetermined speed. Other axle torque requests may also be generated by vehicle stability control systems.

The axle torque arbitration module 204 outputs a predicted torque request and an immediate torque request based on the results of arbitrating between the received torque requests. As described below, the predicted and immediate torque requests from the axle torque arbitration module 204 may selectively be adjusted by other modules of the CTC module 200 before being used to control actuators of the engine system 100.

In general terms, the immediate torque request is the amount of currently desired axle torque, while the predicted torque request is the amount of axle torque that may be needed on short notice. The CTC module 200 therefore controls the engine system 100 to produce an axle torque equal to the immediate torque request. However, different combinations of actuator values may result in the same axle torque. The CTC module 200 may therefore adjust the actuator values to allow a faster transition to the predicted torque request, while still maintaining the axle torque at the immediate torque request.

In various implementations, the predicted torque request may be based on the driver torque request. The immediate torque request may be less than the predicted torque request, such as when the driver torque request is causing wheel slip on an icy surface. In such a case, a traction control system (not shown) may request a reduction via the immediate torque request, and the CTC module 200 reduces the torque produced by the engine system 100 to the immediate torque request. However, the CTC module 200 controls the engine system 100 so that the engine system 100 can quickly resume producing the predicted torque request once the wheel slip stops.

In general terms, the difference between the immediate torque request and the higher predicted torque request can be referred to as a torque reserve. The torque reserve may represent the amount of additional torque that the engine system 100 can begin to produce with minimal delay. Fast engine actuators are used to increase or decrease current axle torque. As described in more detail below, fast engine actuators are defined in contrast with slow engine actuators.

In various implementations, fast engine actuators are capable of varying axle torque within a range, where the range is established by the slow engine actuators. In such implementations, the upper limit of the range is the predicted torque request, while the lower limit of the range is limited by the torque capacity of the fast actuators. For example only, fast actuators may only be able to reduce axle torque by a first amount, where the first amount is a measure of the torque capacity of the fast actuators. The first amount may vary based on engine operating conditions set by the slow engine actuators. When the immediate torque request is within the range, fast engine actuators can be set to cause the axle torque to be equal to the immediate torque request. When the CTC module 200 requests the predicted torque request to be output, the fast engine actuators can be controlled to vary the axle torque to the top of the range, which is the predicted torque request.

In general terms, fast engine actuators can more quickly change the axle torque when compared to slow engine actuators. Slow actuators may respond more slowly to changes in their respective actuator values than fast actuators do. For example, a slow actuator may include mechanical components that require time to move from one position to another in response to a change in actuator value. A slow actuator may also be characterized by the amount of time it takes for the axle torque to begin to change once the slow actuator begins to implement the changed actuator value. Generally, this amount of time will be longer for slow actuators than for fast actuators. In addition, even after beginning to change, the axle torque may take longer to fully respond to a change in a slow actuator.

For example only, the CTC module 200 may set actuator values for slow actuators to values that would enable the engine system 100 to produce the predicted torque request if the fast actuators were set to appropriate values. Meanwhile, the CTC module 200 may set actuator values for fast actuators to values that, given the slow actuator values, cause the engine system 100 to produce the immediate torque request instead of the predicted torque request.

The fast actuator values therefore cause the engine system 100 to produce the immediate torque request. When the CTC module 200 decides to transition the axle torque from the immediate torque request to the predicted torque request, the CTC module 200 changes the actuator values for one or more fast actuators to values that correspond to the predicted torque request.

Because the slow actuator values have already been set based on the predicted torque request, the engine system 100 is able to produce the predicted torque request after only the delay imposed by the fast actuators. In other words, the longer delay that would otherwise result from changing axle torque using slow actuators is avoided.

For example only, when the predicted torque request is equal to the driver torque request, a torque reserve may be created when the immediate torque request is less than the drive torque request due to a temporary torque reduction request. Alternatively, a torque reserve may be created by increasing the predicted torque request above the driver torque request while maintaining the immediate torque request at the driver torque request.

The resulting torque reserve can absorb sudden increases in required axle torque. For example only, sudden loads from an air conditioner or a power steering pump may be counterbalanced by increasing the immediate torque request. If the increase in immediate torque request is less than the torque reserve, the increase can be quickly produced by using fast actuators. The predicted torque request may then also be increased to re-establish the previous torque reserve.

Another example use of a torque reserve is to reduce fluctuations in slow actuator values. Because of their relatively slow speed, varying slow actuator values may produce control instability. In addition, slow actuators may include mechanical parts, which may draw more power and/or wear more quickly when moved frequently. Creating a sufficient torque reserve allows changes in desired torque to be made by varying fast actuators via the immediate torque request while maintaining the values of the slow actuators. For example, to maintain a given idle speed, the immediate torque request may vary within a range. If the predicted torque request is set to a level above this range, variations in the immediate torque request that maintain the idle speed can be made using fast actuators without the need to adjust slow actuators.

For example only, in a spark-ignition engine, spark timing may be a fast actuator value, while throttle position may be a slow actuator value. Spark-ignition engines may combust fuels including, for example, gasoline and ethanol, by applying a spark. By contrast, in a compression-ignition engine, fuel flow may be a fast actuator value, while throttle position may be used as an actuator value for engine characteristics other than torque. Compression-ignition engines may combust fuels including, for example, diesel, via compression.

When the engine 102 is a spark-ignition engine, the spark actuator module 126 may be a fast actuator and the throttle actuator module 116 may be a slow actuator. After receiving a new actuator value, the spark actuator module 126 may be able to change spark timing for the following firing event. When the spark timing (also called spark advance) for a firing event is set to a calibrated value, maximum torque is produced in the combustion stroke immediately following the firing event. However, a spark advance deviating from the calibrated value may reduce the amount of torque produced in the combustion stroke.

Therefore, the spark actuator module 126 may be able to vary engine output torque as soon as the next firing event occurs by varying spark advance. For example only, a table of spark advances corresponding to different engine operating conditions may be determined during a calibration phase of vehicle design, and the calibrated value is selected from the table based on current engine operating conditions.

By contrast, changes in throttle position take longer to affect engine output torque. The throttle actuator module 116 changes the throttle position by adjusting the angle of the blade of the throttle valve 112. Therefore, once a new actuator value is received, there is a mechanical delay as the throttle valve 112 moves from its previous position to a new position based on the new actuator value. In addition, air flow changes based on the throttle valve opening are subject to air transport delays in the intake manifold 110. Further, increased air flow in the intake manifold 110 is not realized as an increase in engine output torque until the cylinder 118 receives additional air in the next intake stroke, compresses the additional air, and commences the combustion stroke.

Using these actuators as an example, a torque reserve can be created by setting the throttle position to a value that would allow the engine 102 to produce a predicted torque request. Meanwhile, the spark timing can be set based on an immediate torque request that is less than the predicted torque request. Although the throttle position generates enough air flow for the engine 102 to produce the predicted torque request, the spark timing is retarded (which reduces torque) based on the immediate torque request. The engine output torque will therefore be equal to the immediate torque request.

When additional torque is needed, such as when the air conditioning compressor is started, or when traction control determines wheel slip has ended, the spark timing can be set based on the predicted torque request. By the following firing event, the spark actuator module 126 may return the spark advance to a calibrated value, which allows the engine 102 to produce the full engine output torque achievable with the air flow already present. The engine output torque may therefore be quickly increased to the predicted torque request without experiencing delays from changing the throttle position.

When the engine 102 is a compression-ignition engine, the fuel actuator module 124 may be a fast actuator and the throttle actuator module 116 and the boost actuator module 164 may be emissions actuators. In this manner, the fuel mass may be set based on the immediate torque request, and the throttle position and boost may be set based on the predicted torque request. The throttle position may generate more air flow than necessary to satisfy the predicted torque request. In turn, the air flow generated may be more than required for complete combustion of the injected fuel such that the air/fuel ratio is usually lean and changes in air flow do not affect the engine output torque. The engine output torque will therefore be equal to the immediate torque request and may be increased or decreased by adjusting the fuel flow.

The throttle actuator module 116, the boost actuator module 164, and the EGR valve 170 may be controlled based on the predicted torque request to control emissions and to minimize turbo lag. The throttle actuator module 116 may create a vacuum to draw exhaust gases through the EGR valve 170 and into the intake manifold 110.

The axle torque arbitration module 204 may output the predicted torque request and the immediate torque request to a propulsion torque arbitration module 206. In various implementations, the axle torque arbitration module 204 may output the predicted and immediate torque requests to a hybrid optimization module 208. The hybrid optimization module 208 determines how much torque should be produced by the engine 102 and how much torque should be produced by the electric motor 198. The hybrid optimization module 208 then outputs modified predicted and immediate torque requests to the propulsion torque arbitration module 206. In various implementations, the hybrid optimization module 208 may be implemented in the hybrid control module 196.

The predicted and immediate torque requests received by the propulsion torque arbitration module 206 are converted from an axle torque domain (torque at the wheels) into a propulsion torque domain (torque at the crankshaft). This conversion may occur before, after, as part of, or in place of the hybrid optimization module 208.

The propulsion torque arbitration module 206 arbitrates between propulsion torque requests, including the converted predicted and immediate torque requests. The propulsion torque arbitration module 206 generates an arbitrated predicted torque request and an arbitrated immediate torque request. The arbitrated torque requests may be generated by selecting a winning request from among received requests. Alternatively or additionally, the arbitrated torque requests may be generated by modifying one of the received requests based on another one or more of the received requests.

Other propulsion torque requests may include torque reductions for engine over-speed protection, torque increases for stall prevention, and torque reductions requested by the transmission control module 194 to accommodate gear shifts. Propulsion torque requests may also result from clutch fuel cutoff, which reduces the engine output torque when the driver depresses the clutch pedal in a manual transmission vehicle to prevent a flare (rapid rise) in the engine speed.

An RPM control module 210 may also output predicted and immediate torque requests to the propulsion torque arbitration module 206. The torque requests from the RPM control module 210 may prevail in arbitration when the ECM 114 is in an RPM mode. The RPM mode may be selected when the driver removes their foot from the accelerator pedal, such as when the vehicle is idling or coasting down from a higher engine speed. Alternatively or additionally, the RPM mode may be selected when the predicted torque request from the axle torque arbitration module 204 is less than a predetermined torque value.

The RPM control module 210 receives a desired RPM from an RPM trajectory module 212, and controls the predicted and immediate torque requests to reduce the difference between the desired RPM and the current RPM. For example only, the RPM trajectory module 212 may output a linearly decreasing desired RPM for vehicle coastdown until an idle RPM is reached. The RPM trajectory module 212 may then continue outputting the idle RPM as the desired RPM.

A reserves/loads module 220 receives the arbitrated predicted and immediate torque requests from the propulsion torque arbitration module 206. The reserves/loads module 220 may adjust the arbitrated predicted and immediate torque requests to create a torque reserve and/or to compensate for one or more loads. The reserves/loads module 220 then outputs the adjusted predicted and immediate torque requests to an actuation module 224.

For example only, a catalyst light-off process or a cold start emissions reduction process may require retarded spark advance. The reserves/loads module 220 may therefore increase the adjusted predicted torque request above the adjusted immediate torque request to create retarded spark for the cold start emissions reduction process. In another example, the air/fuel ratio of the engine 102 and/or the MAF may be directly varied, such as by diagnostic intrusive equivalence ratio testing and/or new engine purging. Before beginning these processes, a torque reserve may be created or increased to quickly offset decreases in engine output torque that result from leaning the air/fuel mixture during these processes.

The reserves/loads module 220 may also create or increase a torque reserve in anticipation of a future load, such as power steering pump operation or engagement of an air conditioning (A/C) compressor clutch. The reserve for engagement of the A/C compressor clutch may be created when the driver first requests air conditioning. The reserves/loads module 220 may increase the adjusted predicted torque request while leaving the adjusted immediate torque request unchanged to produce the torque reserve. Then, when the A/C compressor clutch engages, the reserves/loads module 220 may increase the immediate torque request by the load that the A/C compressor clutch is expected to apply to the engine 102.

The actuation module 224 receives the adjusted predicted and immediate torque requests from the reserves/loads module 220. The actuation module 224 determines how the adjusted predicted and immediate torque requests will be achieved. The actuation module 224 may be engine type specific. For example, the actuation module 224 may be implemented differently or use different control schemes for spark-ignition engines versus compression-ignition engines.

In various implementations, the actuation module 224 may define a boundary between modules that are common across all engine types and modules that are engine type specific. For example only, engine types may include spark-ignition engines and compression-ignition engines. Modules prior to the actuation module 224, such as the propulsion torque arbitration module 206, may be common across engine types, while the actuation module 224 and subsequent modules may be engine type specific.

For example, in spark-ignition engine systems, the actuation module 224 may vary the opening of the throttle valve 112 as a slow actuator that allows for a wide range of torque control. The actuation module 224 may disable cylinders using the cylinder actuator module 120, which also provides for a wide range of torque control, but may also be slow and may involve drivability and emissions concerns. The actuation module 224 may use spark timing as a fast actuator. However, spark timing may not provide as much range of torque control. In addition, the amount of torque control possible with changes in spark timing (referred to as spark reserve capacity) may vary as air flow changes.

In various implementations, the actuation module 224 may generate an air torque request based on the adjusted predicted torque request. The air torque request may be equal to the adjusted predicted torque request, setting air flow so that the adjusted predicted torque request can be achieved by changes to other engine actuators.

An air control module 228 may determine desired actuator values based on the air torque request. For example, the air control module 228 may control desired manifold absolute pressure (MAP), desired throttle position, and/or desired air per cylinder (APC). Desired MAP may be used to determine desired boost, and desired APC may be used to determine desired cam phaser positions. In various implementations, the air control module 228 may also determine an amount of opening of the EGR valve 170.

The actuation module 224 may also generate a spark torque request, a cylinder shut-off torque request, and a fuel torque request. The spark torque request may be used by a spark control module 232 to determine how much to retard the spark timing (which reduces engine output torque) from a calibrated spark advance.

The cylinder shut-off torque request may be used by a cylinder control module 236 to determine how many cylinders to deactivate. The cylinder control module 236 may instruct the cylinder actuator module 120 to deactivate one or more cylinders of the engine 102. In various implementations, a predefined group of cylinders may be deactivated jointly.

The cylinder control module 236 may also instruct a fuel control module 240 to stop providing fuel for deactivated cylinders and may instruct the spark control module 232 to stop providing spark for deactivated cylinders. In various implementations, the spark control module 232 only stops providing spark for a cylinder once any fuel/air mixture already present in the cylinder has been combusted.

In various implementations, the cylinder actuator module 120 may include a hydraulic system that selectively decouples intake and/or exhaust valves from the corresponding camshafts for one or more cylinders in order to deactivate those cylinders. For example only, valves for half of the cylinders are either hydraulically coupled or decoupled as a group by the cylinder actuator module 120. In various implementations, cylinders may be deactivated simply by halting provision of fuel to those cylinders, without stopping the opening and closing of the intake and exhaust valves. In such implementations, the cylinder actuator module 120 may be omitted.

The fuel control module 240 may vary the amount of fuel (e.g., mass or rate) provided to each cylinder based on the fuel torque request from the actuation module 224. During normal operation of a spark-ignition engine, the fuel control module 240 may operate in an air lead mode in which the fuel control module 240 attempts to maintain a stoichiometric air/fuel ratio by controlling fuel flow based on air flow. The fuel control module 240 may determine a fuel mass that will yield stoichiometric combustion when combined with the current amount of air per cylinder. The fuel control module 240 may instruct the fuel actuator module 124 to inject this fuel mass for each activated cylinder.

In compression-ignition engine systems, the fuel control module 240 may operate in a fuel lead mode in which the fuel control module 240 determines a fuel mass for each cylinder that satisfies the fuel torque request while minimizing emissions, noise, and fuel consumption. In the fuel lead mode, air flow is controlled based on fuel flow and may be controlled to yield a lean air/fuel ratio. In addition, the air/fuel ratio may be maintained above a predetermined level, which may prevent black smoke production in dynamic engine operating conditions.

A torque estimation module 244 may estimate the engine output torque. This estimated torque may be used by the air control module 228 to perform closed-loop control of engine air flow parameters, such as the throttle position, the MAP, and the phaser positions. For example, a torque relationship such as $$T=f(\mathrm{APC},S,I,E,\mathrm{AF},\mathrm{OT},\#) \quad (1)$$

may be defined, where torque (T) is a function of air per cylinder (APC), spark advance (S), intake cam phaser position (I), exhaust cam phaser position (E), air/fuel ratio (AF), oil temperature (OT), and number of activated cylinders (#). Additional variables may also be accounted for, such as the degree of opening of an exhaust gas recirculation (EGR) valve.

This relationship may be modeled by an equation and/or may be stored as a lookup table. The torque estimation module 244 may determine APC based on measured MAF and current RPM, thereby allowing closed-loop air control based on actual air flow. The intake and exhaust cam phaser positions used may be based on actual positions, as the phasers may be traveling toward desired positions.

The actual spark advance may be used to estimate the actual engine output torque. When a calibrated spark advance value is used to estimate torque, the estimated torque may be called an estimated air torque, or simply air torque. The air torque is an estimate of how much torque the engine could generate at the current air flow if spark retard was removed (i.e., spark timing was set to the calibrated spark advance value) and all cylinders were fueled.

The air control module 228 may output a desired position signal to the throttle actuator module 116. The throttle actuator module 116 then regulates the throttle valve 112 to produce the desired position. The air control module 228 may generate the desired position signal based on an inverse torque model and the air torque request. The air control module 228 may use the estimated air torque and/or the MAF signal in order to perform closed loop control. For example, the desired position signal may be controlled to minimize a difference between the estimated air torque and the air torque request.

The air control module 228 may output a desired manifold absolute pressure (MAP) signal to a boost scheduling module 248. The boost scheduling module 248 uses the desired MAP signal to control the boost actuator module 164. The boost actuator module 164 then controls one or more turbochargers (e.g., the turbocharger including the turbine 160-1 and the compressor 160-2) and/or superchargers.

The air control module 228 may also output a desired air per cylinder (APC) signal to a phaser scheduling module 252. Based on the desired APC signal and the RPM signal, the phaser scheduling module 252 may control positions of the intake and/or exhaust cam phasers 148 and 150 using the phaser actuator module 158.

Referring back to the spark control module 232, calibrated spark advance values may vary based on various engine operating conditions. For example only, a torque relationship may be inverted to solve for desired spark advance. For a given torque request ($T_{des}$), the desired spark advance ($S_{des}$) may be determined based on $$S_{des}=T^{-1}(T_{des},\mathrm{APC},I,E,\mathrm{AF},\mathrm{OT},\#). \quad (2)$$

This relationship may be embodied as an equation and/or as a lookup table. The air/fuel ratio (AF) may be the actual air/fuel ratio, as reported by the fuel control module 240.

When the spark advance is set to the calibrated spark advance, the resulting torque may be as close to mean best torque (MBT) as possible. MBT refers to the maximum engine output torque that is generated for a given air flow as spark advance is increased, while using fuel having an octane rating greater than a predetermined threshold and using stoichiometric fueling. The spark advance at which this maximum torque occurs is referred to as MBT spark. The calibrated spark advance may differ slightly from MBT spark because of, for example, fuel quality (such as when lower octane fuel is used) and environmental factors. The torque at the calibrated spark advance may therefore be less than MBT.

Referring now to FIGS. 3A and 3B, functional block diagrams of exemplary engine control systems 300 and 350 associated with spark-ignition engine systems and compression-ignition engine systems, respectively, are presented. The ECM 114 may include the CTC module 200, a diagnostic module 302, and an actuator limiting module 304.

As discussed above, the CTC module 200 generally controls the engine actuators, such as the throttle actuator module 116, the cylinder actuator module 120, the fuel actuator module 124, the phaser actuator module 158, and the boost actuator module 164. In spark-ignition engine systems, the CTC module 200 also controls the spark actuator module 126.

However, when a fault is diagnosed that may cause the ECM 114 to shut down the engine 102, the CTC module 200 provides the actuator value for a primary torque actuator to the actuator limiting module 304. For example only, the CTC module 200 of FIG. 3A for spark-ignition engine systems may transmit the desired position for the throttle actuator module 116 to the actuator limiting module 304. In the example of FIG. 3B for compression-ignition engine systems, the CTC module 200 may transmit the fuel mass to the actuator limiting module 304.

The diagnostic module 302 selectively diagnoses the fault that may cause the ECM 114 to shut down the engine 102. The diagnostic module 302 may also diagnose one or more additional faults that may cause the ECM 114 to shut down the engine 102. For example only, the diagnostic module 302 may selectively diagnose the fault when a dual path fault or a dual storage fault occurs. These types of faults may be attributable to a processor (not shown) of the ECM 114, as opposed to other engine shutdown related faults that may be attributable to a fault in random access memory (RAM), read only memory (ROM), an arithmetic logic unit (ALU), a stack, a math library, a clock, register configuration, a math library, etc.

The CTC module 200 determines various parameters that the CTC module 200 may use in controlling the engine actuators. For example only, the CTC module 200 determines the parameters discussed above. As the engine actuators are generally controlled based on the parameters determined by the CTC module 200, the parameters determined by the CTC module 200 may be referred to as being primary path parameters. For example only, the CTC module 200 may determine the torque requests discussed above, various engine capacities, various engine speeds (e.g., actual and desired), various engine torques, various engine airflow parameters, and various air pressures.

The diagnostic module 302 also determines one or more of the parameters that are determined by the CTC module 200. This redundant determination by the diagnostic module 302 creates what may be referred to as a dual or redundant path within the ECM 114, and the parameters determined by the diagnostic module 302 may be referred to as dual path parameters. The diagnostic module 302 may determine the dual path parameters based on the same inputs and the same or similar relationships as those used by CTC module 200 in determining the primary path parameters, respectively.

The diagnostic module 302 may compare ones of the primary path parameters with corresponding ones of the redundant path parameters. The diagnostic module 302 may diagnose a dual path fault when the corresponding primary and dual path parameters differ by more than a predetermined amount or percentage.

In some circumstances, the CTC module 200 may store one of the primary path parameters in two different locations. For example only, the CTC module 200 may store a primary path parameter in two different predetermined locations in memory (not shown). The diagnostic module 302 may read the parameters from the two different locations. The diagnostic module 302 may compare the two parameters and diagnose a dual storage fault when the two parameters are unequal or differ from expected values.

When a dual path fault and/or a dual storage fault is diagnosed, the engine 102 is generally shut down. According to the present disclosure, however, the actuator limiting module 304 limits the actuator value associated with the primary torque actuator when a dual path fault and/or a dual storage fault is diagnosed. In this manner, the ECM 114 of the present disclosure allows the engine 102 to remain running, but the ECM 114 limits the engine output torque. When limiting the actuator value associated with the primary torque actuator, the ECM 114 may be said to be operating in a limp home mode where the engine output torque is limited to allow a driver of the vehicle to drive the vehicle slowly.

The diagnostic module 302 notifies the actuator limiting module 304 and the CTC module 200 when a dual path fault and/or a dual storage fault is diagnosed. The diagnostic module 302 may notify the actuator limiting module 304 and the CTC module 200 via an enabling signal. For example only, the diagnostic module 302 may set the enabling signal to an active state (e.g., 5 V) when a dual path fault and/or a dual storage fault is diagnosed.

The CTC module 200 provides the actuator value associated with the primary torque actuator to the actuator limiting module 304 when a dual path fault and/or a dual storage fault is diagnosed. In this manner, the diagnostic module 302 disables the CTC module's 200 control of the throttle actuator module 116 when an engine shutdown fault is diagnosed. Hereafter, the actuator value associated with the primary torque actuator determined by the CTC module 200 will be referred to as the CTC actuator value.

The actuator limiting module 304 is enabled when a dual path fault and/or a dual storage fault is diagnosed. When a dual path fault and/or a dual storage fault has not been diagnosed since a last vehicle startup (e.g., key ON), the actuator limiting module 304 may be disabled and the CTC actuator value may be provided to the primary torque actuator.

When enabled or when a dual path fault and/or a dual storage fault is diagnosed, the actuator limiting module 304 determines a limited actuator value for the primary torque actuator. For example only, the actuator limiting module 304 may determine a limited position (or area) for the throttle actuator module 116 as shown in the exemplary embodiment of FIG. 3A for spark-ignition engines. The actuator limiting module 304 may determine a limited fueling rate or a limited fuel mass for the fuel actuator module 124 as shown in the exemplary embodiment of FIG. 3B for compression-ignition engines.

The actuator limiting module 304 selects a lesser one of the limited actuator value and the CTC actuator value. The actuator limiting module 304 controls the primary torque actuator based on the lesser one of the limited actuator value and the CTC actuator value. In this manner, the engine output torque is limited to allow the driver to operate the vehicle slowly instead of completely shutting down the engine 102. This ability to operate the vehicle slowly may allow the driver to maneuver the vehicle to a desired location, such as the driver's home or to a vehicle service location.

Figure 4A:
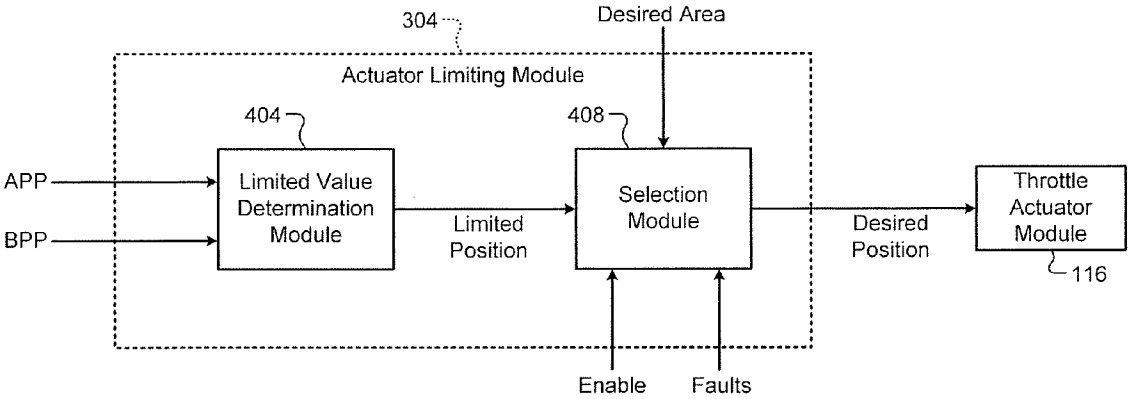
FIGS. 4A and 4B are functional block diagrams of exemplary actuator limiting modules for spark-ignition and compression-ignition engine systems, respectively, according to the principles of the present disclosure.
Figure 4B:
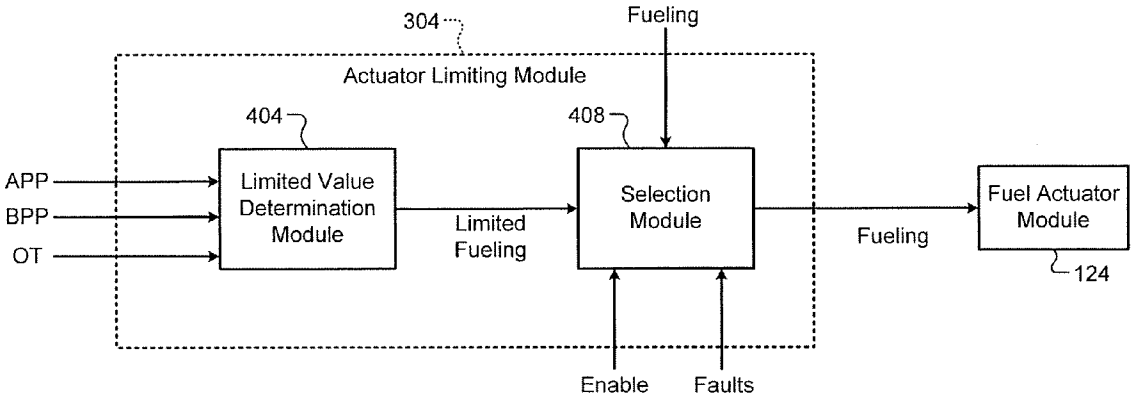

Referring now to FIGS. 4A and 4B, functional block diagram of exemplary implementations of the actuator limiting module 304 for spark-ignition engines and compression-ignition engines, respectively, are presented. The actuator limiting module 304 may include a limited value determination module 404 and a selection module 408.

Referring to FIG. 4A and to spark-ignition engines, the limited value determination module 404 may determine the limited actuator value for the throttle actuator module 116. More specifically, the limited value determination module 404 may determine the limited position for the throttle actuator module 116. The limited value determination module 404 may determine the limited position based on the APP. In various implementations, the APP sensor 106 expresses the APP as a percentage, relative to a resting (i.e., zero or 0%) position of the accelerator pedal.

The limited value determination module 404 may determine the limited position using an equation that relates the APP to the limited position, a mapping that includes an index of APP to limited position, or another suitable relationship. An exemplary graph of APP versus limited position is shown in FIG. 5A.

Figure 5A:
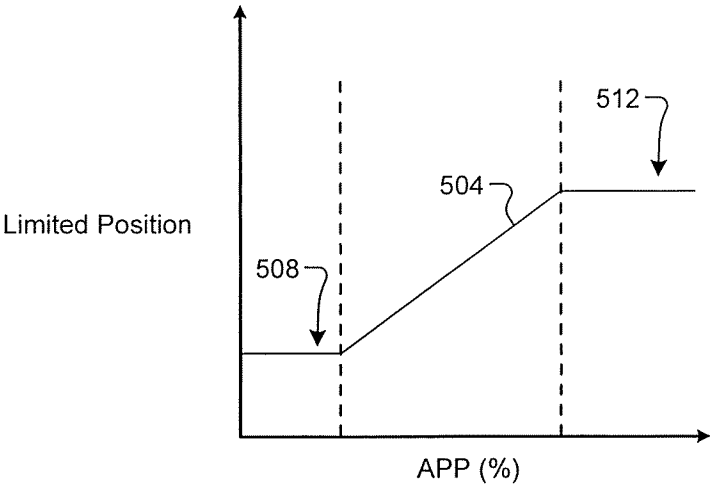
FIGS. 5A and 5B are exemplary graphs of limited actuator values versus accelerator pedal position for spark-ignition and compression-ignition engine systems, respectively, according to the principles of the present disclosure.

Referring now to FIG. 5A, exemplary trace 504 tracks the limited position at various APPs. The limited value determination module 404 may set the limited position 504 equal to a predetermined idle position when the APP is less than a first predetermined APP as indicated by 508. The predetermined idle position may correspond to a position to which the throttle valve 112 is opened during engine idling. For example only, the first predetermined APP may be approximately 10%, and the predetermined idle position may be approximately 10%.

The limited value determination module 404 may also set the limited position 504 equal to a predetermined maximum position when the APP is greater than a second predetermined APP as indicated by 512. The predetermined maximum position may correspond to a maximum allowable position for the throttle valve 112 in the limp home mode. For example only, the predetermined maximum position may correspond to approximately 40% open, and the second predetermined APP may be approximately 40%. Between the predetermined APP and the second predetermined APP, the limited position 504 may have a linear relationship with the APP as shown in the exemplary embodiment of FIG. 5A or another suitable relationship.

Referring back to FIG. 4A, the limited value determination module 404 may determine the limited position further based on the BPP. For example only, the limited value determination module 404 may set the limited position equal to the predetermined idle position when the BPP indicates that the driver is applying pressure to the brake pedal. The limited value determination module 404 may set the limited position equal to the predetermined idle position when the BPP indicates that the driver is applying pressure to the brake pedal and the APP is greater than the first predetermined APP. In various implementations, the BPP sensor 108 expresses the BPP as a percentage, relative to a resting (i.e., zero or 0%) position of the brake pedal. The driver may be applying pressure to the brake pedal when the BPP is greater than the resting position.

Referring now to FIG. 4B and to compression-ignition engines, the limited value determination module 404 may determine the limited actuator value for the fuel actuator module 124. More specifically, the limited value determination module 404 may determine the limited fuel mass for the fuel actuator module 124 or another suitable fueling parameter (e.g., limited fueling rate). Hereafter, the limited actuator value determined by the limited value determination module 404 of FIG. 3B will be referred to as the limited fuel mass.

The limited value determination module 404 may determine the limited fuel mass based on the APP (e.g., %). The limited value determination module 404 may determine the limited fuel mass using an equation that relates the APP to limited fuel mass, a mapping that includes an index of APP to limited fuel mass, or another suitable relationship. An exemplary graph of APP versus limited fuel mass is shown in FIG. 5B.

Figure 5B:
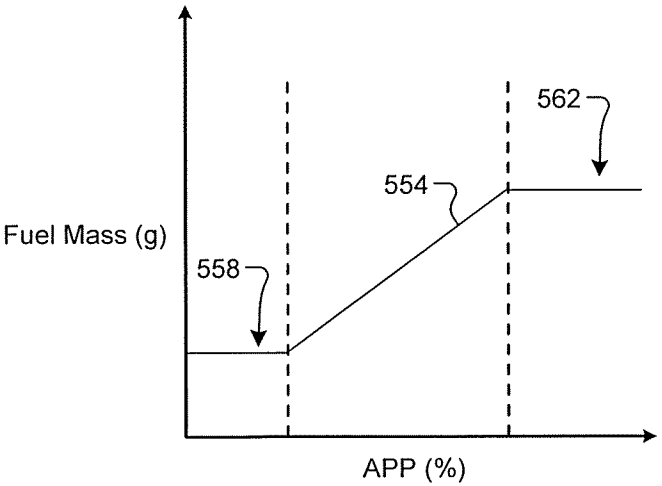

Referring to now FIG. 5B, exemplary trace 554 tracks the limited fuel mass at various APPs. The limited value determination module 404 may set the limited fuel mass 554 equal to a predetermined idle fuel mass when the APP is less than a first predetermined APP as indicated by 558. The predetermined idle fuel mass may correspond to a fuel mass supplied to each cylinder during engine idling. For example only, the first predetermined APP may be approximately 10%.

The limited value determination module 404 may also set the limited fuel mass 554 equal to a predetermined maximum fuel mass when the APP is greater than a second predetermined APP as indicated by 562. The predetermined maximum fuel mass may correspond to a maximum allowable fuel mass when in the limp home mode. For example only, the second predetermined APP may be approximately 40%. Between the first predetermined APP and the second predetermined APP, the limited fuel mass 554 may have a linear relationship with the APP as shown in the exemplary embodiment of FIG. 5A or another suitable relationship.

Referring back to FIG. 4B, the limited value determination module 404 may determine the limited fuel mass further based on the BPP. For example only, the limited value determination module 404 may set the limited fuel mass equal to the predetermined idle fuel mass when the BPP indicates that the driver is applying pressure to the brake pedal. The limited value determination module 404 may set the limited fuel mass equal to the predetermined idle fuel mass when the BPP indicates that the driver is applying pressure to the brake pedal and the APP is greater than the first predetermined APP.

The limited value determination module 404 may determine the limited fuel mass further based on the OT. For example only, the limited value determination module 404 may increase the limited fuel mass as the OT decreases. This increase in the limited fuel mass as the OT decreases may be to offset the increase in friction attributable to the decreased OT.

Written conversely, the limited value determination module 404 may decrease the limited fuel mass as the OT increases. This decrease in the limited fuel mass as the OT increases may be to offset the decrease in friction attributable to the increased OT. The limited value determination module 404 may determine the limited fuel mass using an equation that relates the OT to limited fuel mass, a mapping that includes an index of OT to limited fuel mass, or another suitable relationship.

Referring to FIGS. 4A and 4B, the limited value determination module 404 provides the limited actuator value for the primary torque actuator to the selection module 408. The selection module 408 also receives the CTC actuator value for the primary torque actuator from the CTC module 200. The selection module 408 selects one of the limited actuator value and the CTC actuator value when enabled (i.e., when a dual path fault and/or a dual storage fault is diagnosed).

More specifically, the selection module 408 selects a lesser one of the limited actuator value and the CTC actuator value. The selection module 408 controls the primary torque actuator based on the lesser one of the limited actuator value and the CTC actuator value. For example only, the selection module 408 controls the throttle actuator module 116 based on the lesser one of the limited and CTC actuator values in spark-ignition engine systems as shown in FIG. 4A. The selection module controls the fuel actuator module 124 based on the lesser one of the limited and CTC actuator values in compression-ignition engine systems as shown in FIG. 4B.

The selection module 408 may also verify that a fault has not been diagnosed in the primary torque actuator or in one or more of the sensors whose outputs have been used in determining the limited actuator value for the primary actuator. For example only, the selection module 408 may verify that a fault has not been diagnosed in the APP sensor 106 or in the BPP sensor 108. The selection module 408 may also verify that a fault has not been diagnosed in the OT sensor 178 in compression-ignition engine systems.

The diagnostic module 302 may selectively diagnose faults in the primary torque actuator, the APP sensor 106, the BPP sensor 108, and/or the OT sensor 178. Faults that may be diagnosed in the APP sensor 106, the BPP sensor 108, and/or the OT sensor 178 may include, for example only, out of range faults (e.g., an open circuit or a short circuit state), an out of correlation fault (e.g., a change in output greater than a predetermined amount), and other suitable types of faults. If a fault has been diagnosed in the primary torque actuator, the ECM 114 may shut down the engine 102. If a fault has been diagnosed in the APP sensor 106, the BPP sensor 108, and/or the OT sensor 178, the ECM 114 may allow the engine 102 only to idle.

Figure 6:
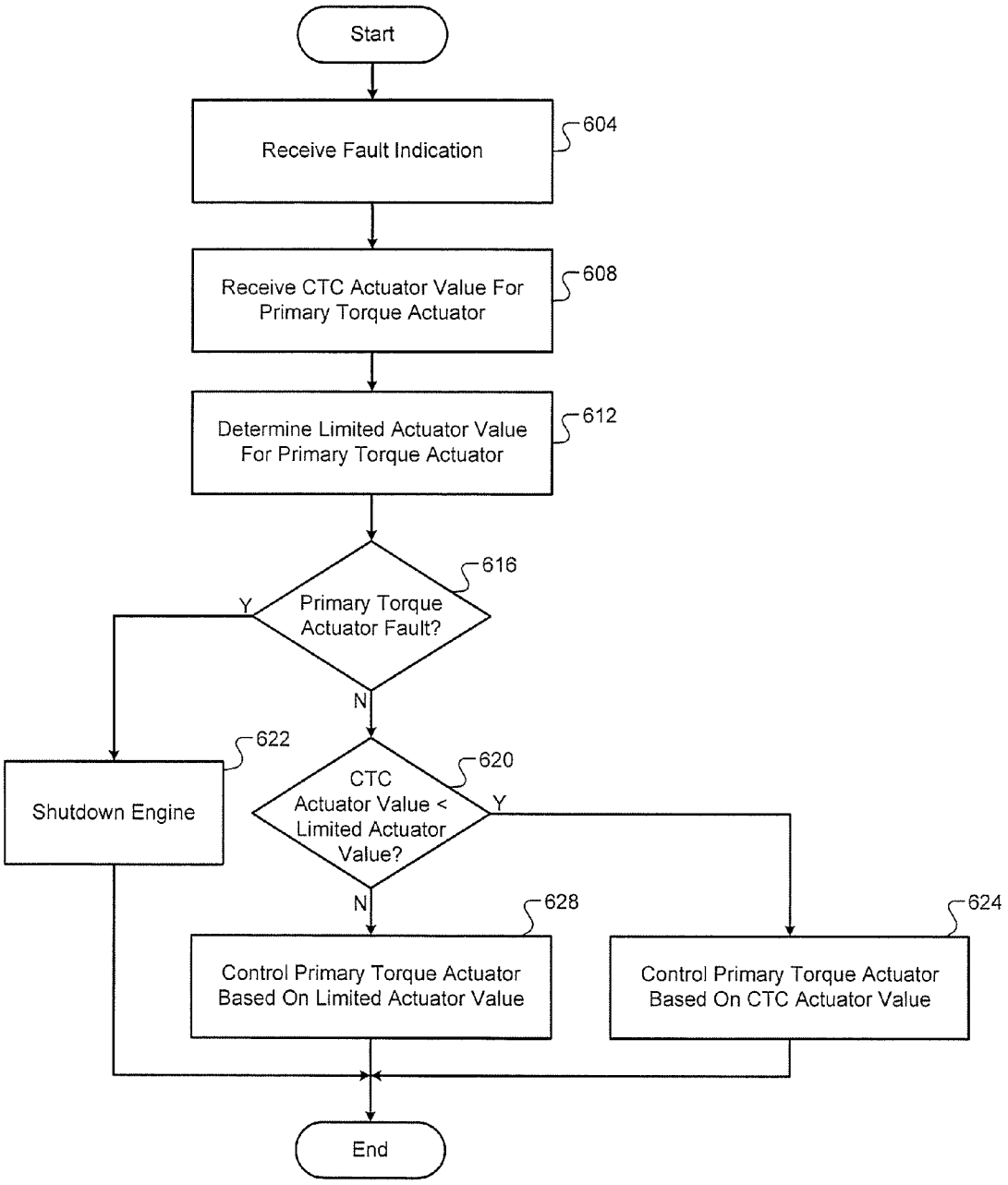
FIG. 6 is a flowchart depicting an exemplary method of controlling a primary torque actuator of an engine when a fault is detected according to the principles of the present disclosure.

Referring now to FIG. 6, a flowchart depicting an exemplary method of controlling a primary torque actuator when a fault that may trigger an engine shutdown is presented. Control may begin with 604 where control may receive an indication of the occurrence of the fault. Control may receive the CTC actuator value for the primary torque actuator at 608.

At 612, control may determine the limited actuator value for the primary torque actuator. For example only, the primary torque actuator may include the fuel actuator module 124 in compression-ignition engine systems or the throttle actuator module 116 in spark-ignition engine systems. Control may determine the limited actuator value based on the APP. Control may determine the limited actuator value further based on the BPP. In compression-ignition systems, control may determine the limited actuator value further based on the OT.

Control may determine whether a fault has occurred at 616. More specifically, control may determine whether a fault has been diagnosed in the primary torque actuator at 616. If false, control may continue with 620; if true, control may shut down the engine 102 at 622 and end.

Control may determine whether the CTC actuator value is less than the limited actuator value at 620. If true, control may control the primary torque actuator based on the CTC actuator value at 624 and control may end; if false, control may control the primary torque actuator based on the limited actuator value at 628 and control may end. In this manner, control controls the primary torque actuator based on the lesser one of the CTC actuator value and the limited actuator value when a dual path fault and/or a dual storage fault is diagnosed. Controlling the primary torque actuator based on the lesser one of the values allows the driver to operate the vehicle to a limited extent (i.e., in the limp home mode) instead of shutting down the engine 102.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system comprising:

a coordinated torque control module that determines a first position for a throttle valve of a spark-ignition internal combustion engine and that controls opening of the throttle valve based on the first position;

a diagnostic module that selectively diagnoses an engine shutdown fault and that disables the control of the opening of the throttle valve based on the first position when the engine shutdown fault is diagnosed; and an actuator limiting module that, in response to the diagnosis of the engine shutdown fault:

determines a second position for the throttle valve based on an accelerator pedal position;

selects a lesser one of the first and second positions; and selectively limits the opening of the throttle valve to the lesser one of the first and second positions to allow engine operation to continue.

2. The engine control system of claim 1 wherein the actuator limiting module determines the second position further based on a brake pedal position.

3. The engine control system of claim 2 wherein the actuator limiting module shuts down the engine when a fault is present in a throttle actuator module when the engine shutdown fault is diagnosed.

4. The engine control system of claim 1 wherein the actuator limiting module limits the second position to a predetermined idle position when the accelerator pedal position is less than a predetermined minimum accelerator pedal position.

5. The engine control system of claim 1 wherein the actuator limiting module limits the second position to a predetermined maximum position when the accelerator pedal position is greater than a predetermined maximum accelerator pedal position.

6. The engine control system of claim 1 wherein the actuator limiting module limits the second position to a predetermined idle position when the accelerator pedal position is less than a first predetermined accelerator pedal position and limits the second position to a predetermined maximum position when the accelerator pedal position is greater than a second predetermined accelerator pedal position.

7. The engine control system of claim 6 wherein the actuator limiting limits the second position to the predetermined idle position when a brake pedal position is greater than a zero brake pedal position.

8. The engine control system of claim 7 wherein the actuator limiting module limits the second position to the predetermined idle position when the brake pedal position is greater than a zero brake pedal position and the accelerator pedal position is greater than the first predetermined accelerator pedal position.

9. The engine control system of claim 1 wherein the coordinated torque control module further determines a first parameter based on one or more inputs and one or more relationships that relate the one or more inputs to the first parameter, and wherein the diagnostic module determines a second parameter that corresponds to the first parameter based on the one or more inputs and diagnoses the fault based on a comparison of the first parameter and the second parameter.

10. The engine control system of claim 1 wherein the coordinated torque control module further stores values in two different locations in memory, and wherein the diagnostic module reads the values and diagnoses the fault based on at least one of a comparison of the values and a comparison of the values with expected values.

11. An engine control system comprising:

a coordinated torque control module that determines a first fueling amount for a compression-ignition internal combustion engine and that controls provision of fuel to the engine based on the first fueling amount;

a diagnostic module that selectively diagnoses an engine shutdown fault and that disables the control of the provision of fuel based on the first fueling amount when the engine shutdown fault is diagnosed; and an actuator limiting module that, in response to the diagnosis of the engine shutdown fault:

determines a second fueling amount for the engine based on an accelerator pedal position;

selects a lesser one of the first and second fueling amounts; and selectively limits the provision of fuel to the engine to the lesser one of the first and second fueling amounts to allow engine operation to continue.

12. The engine control system of claim 11 wherein the actuator limiting module determines the second fueling amount further based on a brake pedal position.

13. The engine control system of claim 12 wherein the actuator limiting module shuts down the engine when a fault is present in a fuel actuator module when the engine shutdown fault is diagnosed.

14. The engine control system of claim 11 wherein the actuator limiting module limits the second fuel amount to a predetermined idle fuel amount when the accelerator pedal position is less than a predetermined minimum accelerator pedal position.

15. The engine control system of claim 11 wherein the actuator limiting module limits the second fuel amount to a predetermined maximum fuel amount when the accelerator pedal position is greater than a predetermined maximum accelerator pedal position.

16. The engine control system of claim 11 wherein the actuator limiting module limits the second fuel amount to a predetermined idle fuel amount when the accelerator pedal position is less than a first predetermined accelerator pedal position and limits the second fuel amount to a predetermined maximum fuel amount when the accelerator pedal position is greater than a second predetermined accelerator pedal position.

17. The engine control system of claim 16 wherein the actuator limiting limits the second fuel amount to the predetermined idle fuel amount when a brake pedal position is greater than a zero brake pedal position.

18. The engine control system of claim 17 wherein the actuator limiting module limits the second fuel amount to the predetermined idle fuel amount when the brake pedal position is greater than a zero brake pedal position and the accelerator pedal position is greater than the first predetermined accelerator pedal position.

19. The engine control system of claim 11 wherein the actuator limiting module determines the second fuel amount further based on an engine oil temperature.

20. The engine control system of claim 19 wherein the actuator limiting module increases the second fuel amount as the engine oil temperature decreases and decreases the second fuel amount as the engine oil temperature increases.

* * * * *